US006164042A

United States Patent [19]

Tobolka

[11] Patent Number: 6,164,042

[45] **Date of Patent: *Dec. 26, 2000**

[54] CONTAINER WITH DISPENSING SPOUT AND METHOD FOR MAKING SAME

[75] Inventor: Stefan Tobolka, Ontario, Canada

[73] Assignee: Arkmount Systems Inc., Toronto, Canada

[ * ] Notice: This patent is subject to a terminal disclaimer.

[21] Appl. No.: 09/077,494

[22] PCT Filed: Nov. 28, 1996

[86] PCT No.: PCT/CA96/00783

§ 371 Date: Sep. 22, 1998

§ 102(e) Date: Sep. 22, 1998

[87] PCT Pub. No.: WO97/19852

PCT Pub. Date: Jun. 5, 1997

[51] Int. Cl.[7] ..... B65B 9/12; B65D 75/58

[52] U.S. Cl. ..... 53/451; 53/133.8; 53/412; 53/551

[58] Field of Search ..... 53/451, 450, 552, 53/551, 550, 554, 412, 133.8, 133.7, 133.6, 133.5, 133.3; 493/212, 930, 963

[56] References Cited

U.S. PATENT DOCUMENTS

| | | | |
|---|---|---|---|
| 2,339,896 | 1/1944 | Waters | 226/56 |
| 2,866,488 | 12/1958 | Thompson | 150/0.5 |
| 2,999,627 | 9/1961 | Reinhardt | 229/53 |
| 3,009,498 | 11/1961 | Fohr | 150/9 |
| 3,325,961 | 6/1967 | Lindh et al. | 53/28 |
| 3,378,988 | 4/1968 | McClosky | 53/180 |
| 3,381,441 | 5/1968 | Condo, Jr. et al. | 53/24 |
| 3,387,701 | 6/1968 | Schneider et al. | 206/46 |
| 3,482,373 | 12/1969 | Morris | 53/112 |
| 3,488,915 | 1/1970 | Delestatius | 53/112 |
| 3,849,965 | 11/1974 | Dominici | 53/28 |
| 4,041,851 | 8/1977 | Jentsch | 93/35 SB |
| 4,361,235 | 11/1982 | Gautier | 206/527 |
| 4,384,440 | 5/1983 | Ohlsson | 53/412 |
| 4,464,156 | 8/1984 | Holmstrom | 493/194 |
| 4,566,249 | 1/1986 | Schwerdtel et al. | 53/55 |
| 4,649,696 | 3/1987 | Brie et al. | 53/479 |
| 4,747,253 | 5/1988 | Schulte | 53/433 |
| 4,848,063 | 7/1989 | Niske | 53/451 |
| 4,861,414 | 8/1989 | Vogan | 53/133.8 X |
| 5,031,386 | 7/1991 | Schneider | 53/551 |
| 5,170,609 | 12/1992 | Bullock et al. | 53/434 |
| 5,220,771 | 6/1993 | Burns | 53/551 |
| 5,378,065 | 1/1995 | Tobolka | 383/9 |
| 5,408,807 | 4/1995 | Lane, Jr. et al. | 53/551 |
| 5,430,987 | 7/1995 | Lane, Jr. et al. | 53/133.8 |
| 5,454,208 | 10/1995 | Kawano | 53/410 |
| 5,715,656 | 2/1998 | Pearce | 53/451 |
| 5,755,076 | 5/1998 | Otsuka | 53/373.7 |
| 5,761,884 | 6/1998 | Tobolka | 53/451 |

FOREIGN PATENT DOCUMENTS

| | | |
|---|---|---|
| 915519 | 1/1993 | United Kingdom . |
| 2271753 | 4/1994 | United Kingdom . |

*Primary Examiner*—James F. Coan
*Attorney, Agent, or Firm*—Baker & Daniels

[57] ABSTRACT

A container for fluids or liquids is formed of flexible material such as plastic and includes a body having an internal reservoir and a tubular spout extending upwardly from the body. The spout has an internal passage in fluid communication with the body. A constriction in the container creates a low pressure zone in the passage downstream of the constriction as liquid flows along the internal passage. Means are also provided to inflate the spout as fluid flows along the internal passage. A method of forming fluid-filled containers from a tube of flexible material and a method of forming a self-supporting fluid-filled container are also disclosed.

13 Claims, 10 Drawing Sheets

CONTAINER WITH DISPENSING SPOUT AND METHOD FOR MAKING SAME

FIELD OF THE INVENTION

The present invention relates to containers and in particular to a container adapted to hold a fluid or liquid such as a beverage or the like. The present invention also relates to a method of forming fluid-filled containers from a tube of flexible material and to a method of forming a self-supporting fluid-filled container.

BACKGROUND OF THE INVENTION

Containers to hold fluids or liquids such as beverages are well known in the art. One such known beverage container, commonly referred to as a Tetra-Pack™, includes a generally rectangular parallelpiped body formed from layers of laminated material. At the top of the body is a foil or plastic covered aperture through which a straw or the like may be pushed to allow an individual to drink the contents of the container. Although these containers are widely used, their design does not make them readily recyclable and after use, they are typically disposed of through landfill.

An alternative container design is disclosed in U.S. Pat. No. 5,378,065 to Tobolka. The Tobolka container is formed of a unitary pieces of plastic material folded and bonded at appropriate locations to define a body having an internal reservoir and an integrally formed spout in fluid communication with the internal reservoir. The spout extends upwardly from the body of the container and defines a straw to allow an individual to drink the contents of the container. A restriction in the container is positioned at the juncture between the body of the container and the spout to reduce the pressure of fluid flowing from the body to the spout. This gives the individual more control over the velocity of the out-flowing fluid.

Although this container is satisfactory, improved container designs are continually being sought. It is before an object of the present invention to provide a novel container for fluids such as beverages or the like. It is also an object of the present invention to provide a novel method of forming fluid-filled containers from a tube of flexible material and to a method of forming a self-supporting fluid-filled container.

SUMMARY OF THE INVENTION

According to one aspect of the present invention there is provided a method of forming fluid-filled containers from a tube formed of flexible material, said tube being at least partially filled with fluid, said method comprising the step of:

forming transverse, longitudinally spaced seals across said tube between which fluid is located, said seals being configured to define interlocking, alternately oriented containers having narrow spouts and wider bodies.

Preferably, the seals are formed in succession in a downstream to upstream direction with fluid being displaced in the tube between each successively formed seal. It is also preferred that the seals are configured to define tapered containers with the taper of the bodies being the same as the taper of the spouts.

According to another aspect of the present invention there is provided a method of forming a fluid-filled container from a fluid-filled tube formed of flexible material comprising the steps of:

forming a pair of spaced, transverse seals across said tube defining sides of said container and being configured to define a body having an internal reservoir and a narrow spout in fluid communication with said reservoir extending generally centrally from said body; and separating said container from said tube.

According to yet another aspect of the present invention there is provided a container for fluids or liquids formed of flexible material comprising:

a body having an internal reservoir;

a tubular spout extending from said body and having an internal passage in fluid communication with said reservoir;

a constriction in said container to create a low pressure zone in said passage downstream of said constriction as liquid flows from said reservoir into said passage; and means to inflate the spout as liquid flows along said passage.

Preferably the container is formed from a unitary piece of material. It is also preferred that the constriction is defined by at least one projection on an internal wall of the spout which extends into the internal passage. In one embodiment, the constriction is defined by a pair of diametrically opposed projections on the internal wall. In another embodiment, the constriction is defined by an obstruction extending across the passage which resembles an inverted wing.

According to still yet another aspect of the present invention there is provided a method of forming a self-supporting fluid-filled container having a body with an internal reservoir filled with fluid and a narrow spout in fluid communication with said body, said container being formed from a unitary sheet of flexible material folded and bonded at appropriate locations, said body being outwardly tapered towards the bottom thereof, said method comprising the steps of:

(i) pinching opposed bottom corners of said body to form generally flattened triangular portions extending outwardly therefrom; and (ii) forming seals along the pinch lines to create a generally planar base.

According to still yet another aspect of the present invention there is provided a tear mechanism for a fluid-filled container formed of flexible material and having a closed spout, said tear mechanism comprising:

an inwardly direct slit formed in and partially extending across a seal running along one side of said spout; and a hole formed in said seal inward and spaced from said slit, said hole and slit being aligned to define a line of tearing across said spout.

The present invention provides advantages in that the design of the containers is such that the containers can be formed from a tube of flexible material after the tube has been filled with liquid while minimizing material waste. This is achieved by forming interlocked, alternately oriented containers in the tube. Also, the container can be made self-supporting after having been filled with liquid. The present invention also provides advantages in that the constriction reduces the pressure of liquid flowing from the reservoir into the spout giving an individual more control over the velocity of out-flowing fluid while the gradual tapering of the spout ensures that the spout generally fully inflates as fluid flows along the spout.

BRIEF DESCRIPTION OF THE DRAWINGS

Embodiments of the present invention will now be described more fully with reference to the accompanying drawings in which.

DESCRIPTION OF THE PREFERRED EMBODIMENTS

Figure 1A:
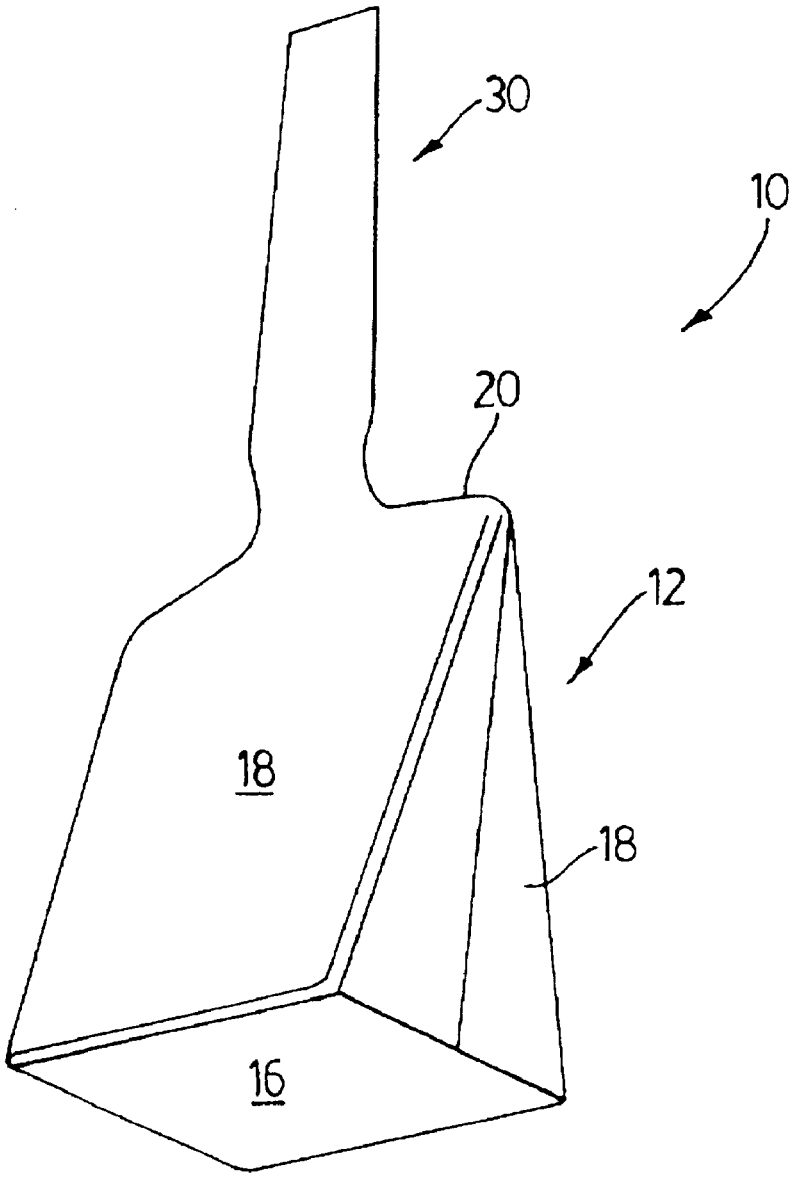
FIG. 1*a* is a perspective view of an embodiment of a self-supporting container for fluids in accordance with the present invention.
Figure 1B:
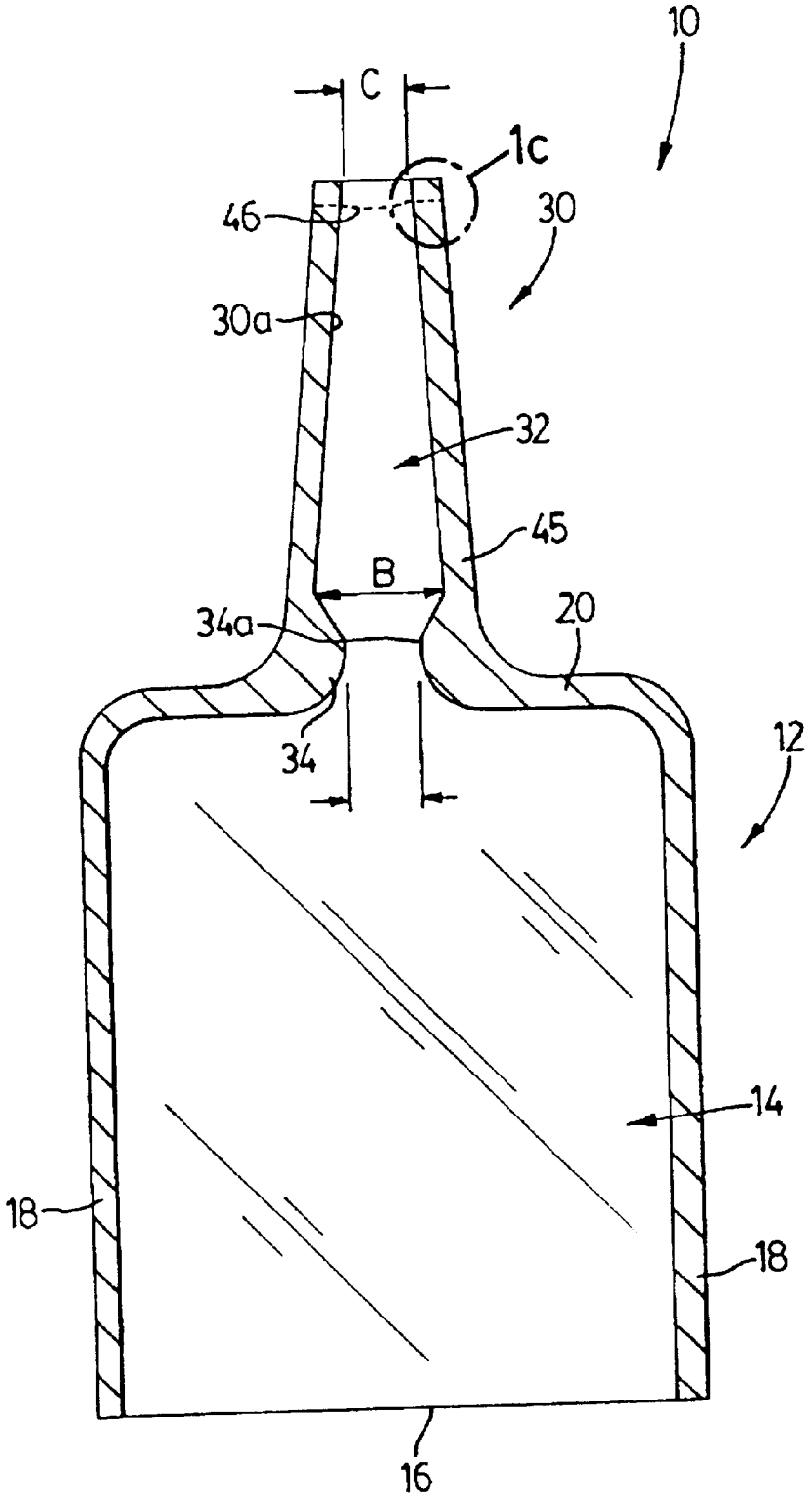
FIG. 1*b* is a cross-sectional view in side elevation of the container of FIG. 1*a;*

Referring now to FIGS. 1*a* and 1*b,* an embodiment of a self-supporting container for fluids or liquids such as beverages or the like is shown and is generally indicated by reference numeral 10. The container 10 is formed of any suitable generally light weight, flexible material. For example, the container 10 may be formed from any suitable plastic material such as for example, polyethylene, polypropylene or polyvinylchloride or alternatively laminated and/or co-extruded multi-layer films. If desired, the plastic material may be coated with a leak inhibiting material such as for example $SiO_2$. Alternatively, the container 10 may be formed of other material such as aluminium foil or an aluminium sprayed film.

In the preferred embodiment, the container 10 is formed from a sheet of plastic film (either coated or uncoated) which has been folded and bonded at appropriate locations. As can be seen, container 10 has a hollow, generally rectangular main body 12 defining an internal reservoir 14 for holding fluid. The main body 12 has a generally rectangular base 16, generally upright sidewalls 18 about the periphery of the base 16 and shoulders 20 extending upwardly from the sidewalls 18. A spout 30 is integrally formed with the body 12 and extends upwardly from the shoulder 20, centrally of the container 10. The spout 30 has an internal passage 32 which is in fluid communication with the reservoir 14.

Figure 1C:
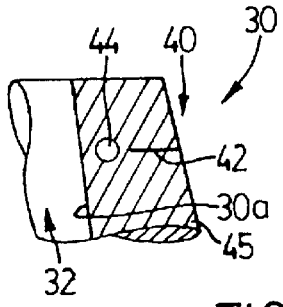
FIG. 1*c* is an enlarged view of a portion of FIG. 1*b* indicated to by arrow 1*c;*

A tearing mechanism 40 is formed in the spout 30 adjacent the distal end of the spout (see FIG. 1*c*). The tearing mechanism 40 includes a slit 42 and a pin-hole 44 formed in a seam 45 running the length of the container. The slit 42 and pin-hole 44 are slightly spaced apart and are aligned to define a tear line 46 across which a tear in the spout 30 is to be made to open the container 10 as shown by the dotted line in FIG. 1*b*.

A restricted area in the spout 30 is defined by a pair of opposed projections 34 formed on the internal wall 30*a* of the spout. The projections 34 are positioned at the juncture between the spout 30 and the shoulder 20. The spout, above the projections, gradually tapers inwardly towards its distal end. The projections 34 are shaped so that the diameter A of the passage 32 at the projections 34 is less than the diameter B of the passage just downstream of the projections 34. The diameter C of the internal passage 32 at the tear line 46 may be greater than or less than or equal to the diameter A.

In the case of the non-viscous fluids, it is preferred that the diameter A is approximately equal to between about one-third (⅓) to about one-half (½) of the diameter B and that the diameter C is approximately ten percent (10%) larger than the diameter A. In the case of viscous fluids or in cases where accurate delivery of the fluid is desired, it is desirable to dimension the spout 30 so that the diameter C is less than or equal to the diameter A. In this case, fluid will travel along the spout 30 with relatively higher velocity but due to the small volume of fluid in the spout as a result of the projections 34, the desired controlled fluid flow existing the spout is achieved.

Figure 1D:
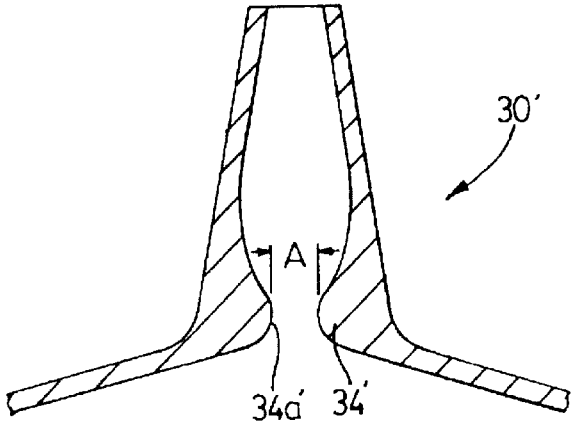
FIG. 1*d* is an enlarged cross-sectional view of a portion of a container showing an alternative spout restriction.
Figure 1E:
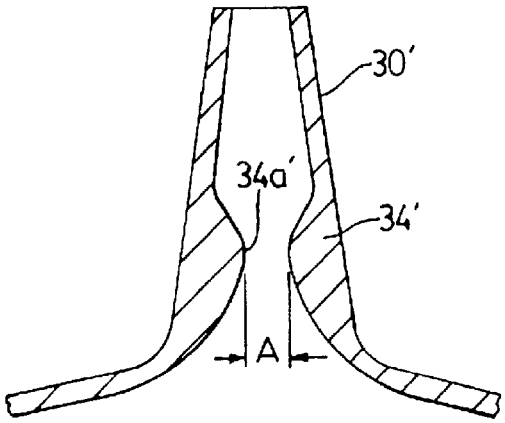
FIG. 1*e* is an enlarged cross-sectional view of a portion of a container showing yet another alternative spout restriction.

In this particular embodiment, the projections 34 have interior surfaces 34*a* which generally define arcs of a circle although it should be apparent to those of skill in the art that alternative shapes can be selected depending on the fluid-flow control that is desired. For example, FIGS. 1*d* and 1*e* show alternative projection configurations. As can be seen, the interior surfaces 34*a*' of the projections in FIG. 1*d* are generally "pear-shaped" and curve sharply below the diameter A and gradually above the diameter A. In FIG. 1*c,* the interior surfaces 34*a*' of the projections 34' curve gradually below the diameter A and more sharply above the diameter A. These latter two projection configurations provide a delay before fluid exits the spout 30' if pressure is applied to the container body when the spout is open.

Before use, the spout 30 is typically deflated and the reservoir 14 holds all of the fluid in the container 10. The spout 30 which acts as a straw may be folded over one of the sidewalls 18 and attached to it with a small amount of adhesive. When it is desired to open the container 10, if the spout 30 is attached to a sidewall 18, it must be released from the sidewall by breaking the adhesive bond. To open the container 10 once the spout 30 has been released from the sidewall 18 if necessary, the distal end of the spout 30 is torn along the tear line 46. Tearing of the distal end of spout 30 in this manner is facilitated by the slit 42. The pin-hole 44 helps to direct the line of tearing when the tear is started via the slit 42.

After this has been done, when it is desired to dispense fluid from the reservoir 14 and pressure is applied to the body 12, the fluid in the reservoir flows into the passage 32 of the spout 30. The restricted area defined by the projections 34 represents a pressure increase zone while the area of the passage just downstream of the projections 34 represents a pressure drop zone. Fluid exiting the reservoir 14 and passing through the restricted area into the low pressure zone exits the container 10 with a pressure drop as compared to the pressure at the restricted area thereby giving an individual more control over the velocity of out-flowing fluid. The inward taper of the spout 30 towards its open distal end results in an increase in pressure as fluid flows along the spout 30 after passing through the restricted area. This increase in pressure helps to ensure that the spout 30 substantially fully inflates as fluid flows along the spout.

Figure 2:
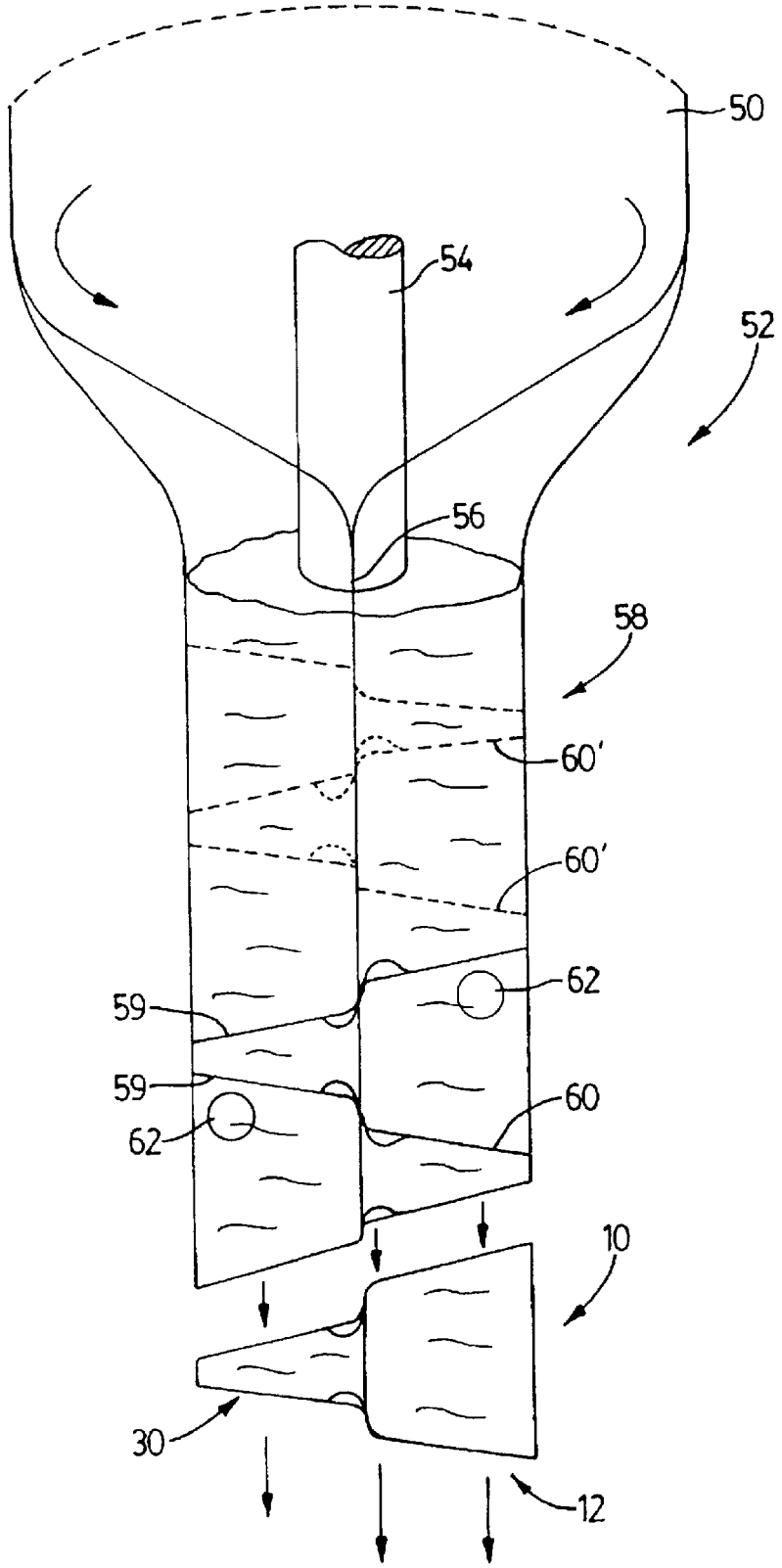
FIG. 2 is a side elevational view of an apparatus for forming and filling a tube with fluid and then partitioning the tube to form fluid-filled containers which when made self-supporting will be of the type illustrated in FIG. 1*a;*

Referring now to FIG. 2, an apparatus to create and fill containers 10 from a plastic sheet 50 is shown and is generally indicated to by reference numeral 52. The apparatus 52 folds the sheet and seals the sheet along heat seal line 56 to form a tube 58. The tube 58 is delivered around a fluid delivery conduit 54. Below the fluid delivery conduit 54 is a heat sealing machine. In this embodiment, the heat sealing machine includes a pair of vertically spaced heat sealing bars 59 configured to form transverse heat seals 60 in the tube 58 which define opposed sides of a container 10, and the opposed projection 34 within the container spout 30. Associated with each heat sealing bar 59 is a fluid displacement mechanism 62.

Initially, the heat sealing machine forms a heat seal 60 at the bottom of the tube 58. Fluid to be held in the container 10 is delivered to the tube 58 by the fluid delivery conduit 54. As the tube 58 fills with fluid, the tube 58 is advanced towards the heat sealing machine so that successive heat seals 60 can be formed transversely across the tube 58. When the fluid-filled tube 58 reaches the heat sealing machine, the fluid level in the tube is above the heat sealing bars 59 so that the containers 10 when formed will be completely filled with fluid and void of air or other gasses thereby extending the product life.

When the heat sealing machine is operated, the fluid displacement mechanism 62 associated with the downstream heat sealing bar 59 is brought into contact with the tube 58 to displace fluid in the tube 58. At this stage, the downstream heat sealing bar 59 is brought into contact with the tube 58 to form a transverse heat seal 60. Following this and shortly thereafter, the fluid displacement mechanism 62 associated with the upstream heat sealing bar 59 is brought into contact with the tube 58 to displace fluid in the tube 58. Shortly after this, the upstream heat sealing bar 59 is brought into contact with the tube 58 to form a transverse heat seal 60 and thereby define the sides of a pair of fluid-filled containers 10. Thus, the fluid displacement mechanisms 62 and the heat sealing bars 59 are operated in succession in a downstream to upstream direction. The fluid displacement mechanisms 62 displace sufficient fluid so that after the containers 10 have been formed there is sufficient room to pinch the sides of the containers to make the containers self-supporting (as will be described) and also so that the fluid level in the containers fills only the reservoir 14 creating a vacuum in the spout 30 causing it to deflate. This allows the spouts 30 to be folded over the bodies 12 and attached to the sidewalls 18. Once the heat seals 60 have been formed in the tube 58, the apparatus 52 advances the tube to allow the next pair of containers 10 to be formed.

In FIG. 2, the dashed lines 60' represent the configuration of the heat seals to be formed as the tube 58 advances towards the heat sealing machine. If the flexible material used to form the tube 58 is thin, the heat seals 60 may be formed using heat sealing bars which not only heat seal the tube 58 to define the sides of a pair of adjacent containers 10 but which also cut the tube 58 so that each fluid-filled container separates from the bottom of tube 58 as it is formed. The weight of the fluid-filled container of course assists the separation process. However, if the flexible material used to form the tube 58 is thick and/or is laminated, it is preferred that the heat sealing and cutting stages be performed in a two-step process. In this case, it is preferred that heat sealing bars be used to form the heat seals 60 and that a die-cut operation be used to cut along the heat seals 60 to separate the containers from the tube 58. The heat sealing bars must of course be selected to form heat seals which are thick enough to accommodate the die-cutting operation without compromising the integrity of the heat seals 60.

In order to minimize waste during formation of the containers 10 from the tube 58, the heat seals 60 are configured such that the relative lengths of the spout 30 and body 12 of each container 10 are made equal so that successive containers are interlocked and alternatively oriented in opposite directions. The heat seals are also configured so that the containers are tapered with the taper of the bodies being selected to correspond to the taper of the spouts. The taper of the bodies allows the sidewalls of the body to take a more upright orientation when the containers are made to be self-supporting as will be described.

Although the apparatus 52 is shown forming the heat seal 56 so that the heat seal traverses the containers 10 intermediate their ends after they have been formed, the apparatus can of course from the heat seal 56 so that it extends along the tube 58 adjacent the ends of the heat seals 60. In this case, the heat seal 56 will extend along the base of every other container and along the distal end of spout of the other containers.

Figure 4C:
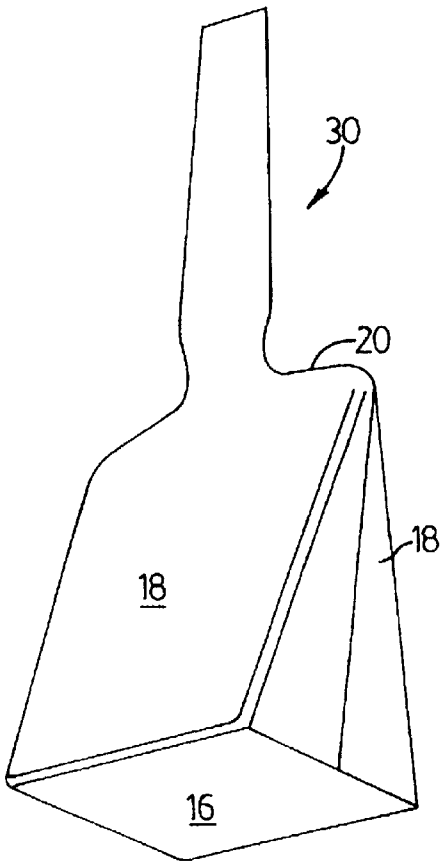
FIGS. 4*a,* 4*b* and 4*c* are perspective views showing the steps performed to make the container of FIG. 1*a* self-supporting.
Figure 4B:
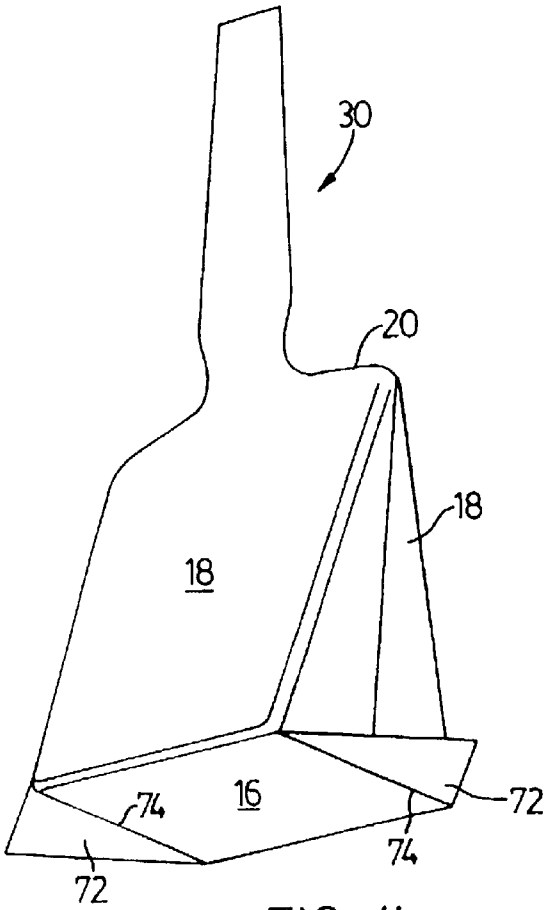
Figure 4A:
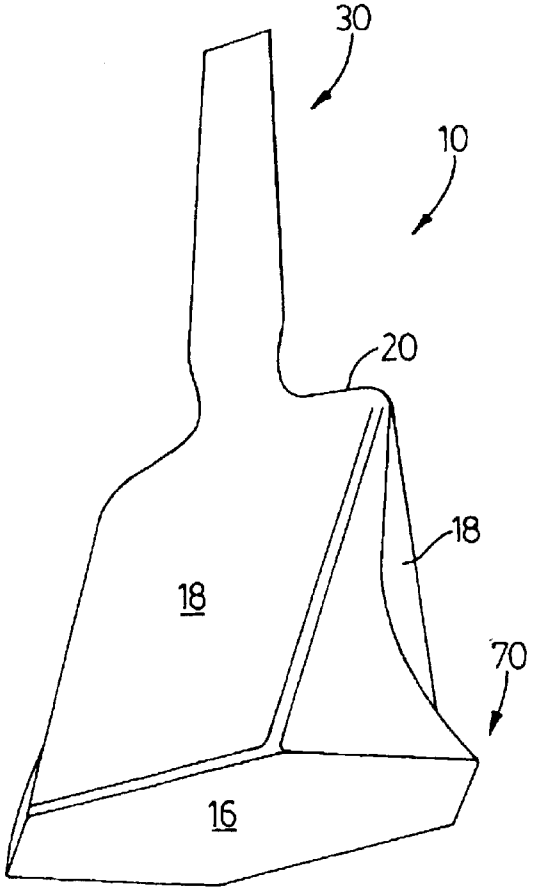

To make the container 10 self-supporting after the containers have been filled with fluid and separated from the tube 58, opposed sidewalls 18 of the container 10 are pushed inwardly and the bottom corners 70 of the body 12 are flattened and pinched to form flattened triangular portions 72. Heat seals 74 are then formed along the pinch lines and the triangular portions 72 are separated from the body along the heat seals 74 to create the rectangular base 16. FIGS. 4*a* to 4*c* best illustrate the above described steps. The outwardly tapering sides of the body 12 which exist after the fluid-filled container has been separated from the tube 58 and the room created in the container due to the displacement of fluid, allow the container 10 to be made self-supporting while ensuring that the sidewalls 18 of the body 12 are generally upright. If desired, the triangular portions 72 need not be removed from the body 12 but instead may be folded about the heat seals 74 to overlie the base 16 or sidewalls 18 and may be attached to the base or sidewalls by adhesive or other suitable means. The slit 42 and pin-hole 44 can be formed in the seam 45 either before or after the container is made self-supporting.

Because the containers are formed by transverse heat seals across the tube 58 after the tube has been filled with fluid, the present method of forming a fluid-filled container is particularly suited to aseptic packaging.

Figure 3:
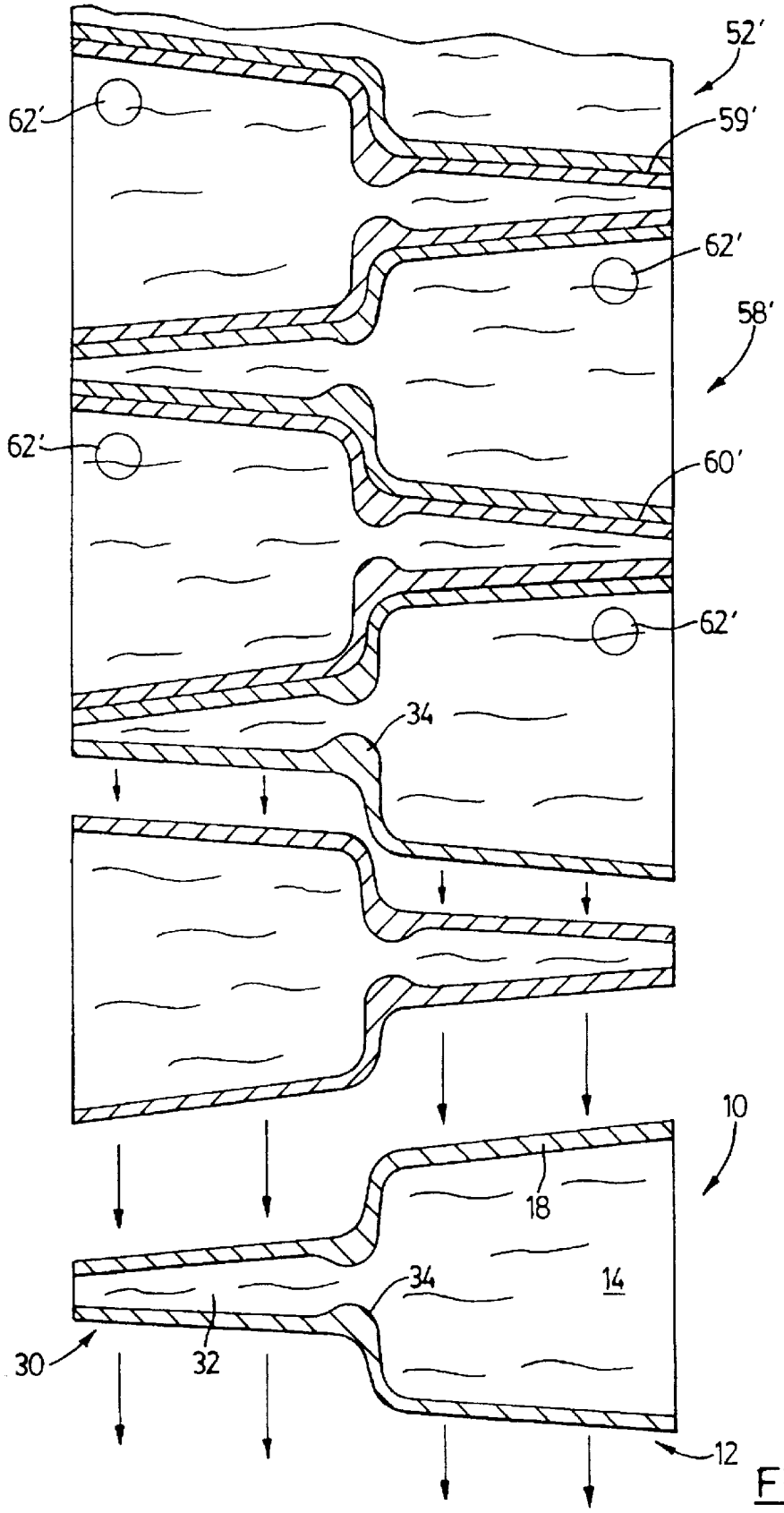
FIG. 3 is a cross-sectional view in side elevation of another embodiment of an apparatus for forming and filling a tube and then partitioning the tube to form fluid-filled containers which when made self-supporting will be of the type illustrated in FIG. 1*a;*

Although the process for creating the containers has been described as using heat sealing bars to seal and either the heat sealing bars or a die-cut operation to separate a pair of containers from the end of the tube 58 as they are formed, those of skill in the art will appreciate that a heat sealing machine having multiple pairs of heat sealing bars may be used to form successive heat seals across the tube 58 to partition the end of the tube into a string of containers, each filled with fluid. FIG. 3 shows an apparatus 52' including two pairs of heat sealing bars 59' and four fluid displacement mechanisms 62', each of which is associated with one of the heat sealing bars. When the fluid displacement mechanisms and heat sealing bars are operated in succession, four containers 10 are formed in the tube 58. In this case, as the containers 10 are formed and filled with fluid, they can be separated by the heat sealing bars or via a die-cutting operation. In the above cases, once the multiple containers have been formed, the tube 58' is advanced by an indexing mechanism so that another string of containers can be formed.

Alternatively, if desired, the string of containers can be kept intact and perforations can be formed along the heat seals 60' to allow the containers to be removed from the string at any desired time. In this case, the string of containers will typically be packaged and sold as a single unit.

Although the containers 10 have been described as having spouts and bodies of equal length, the shape of the containers and the relative lengths of the bodies and spouts can of course be changed, although this will result in wasted material during the container formation process.

Figure 5:
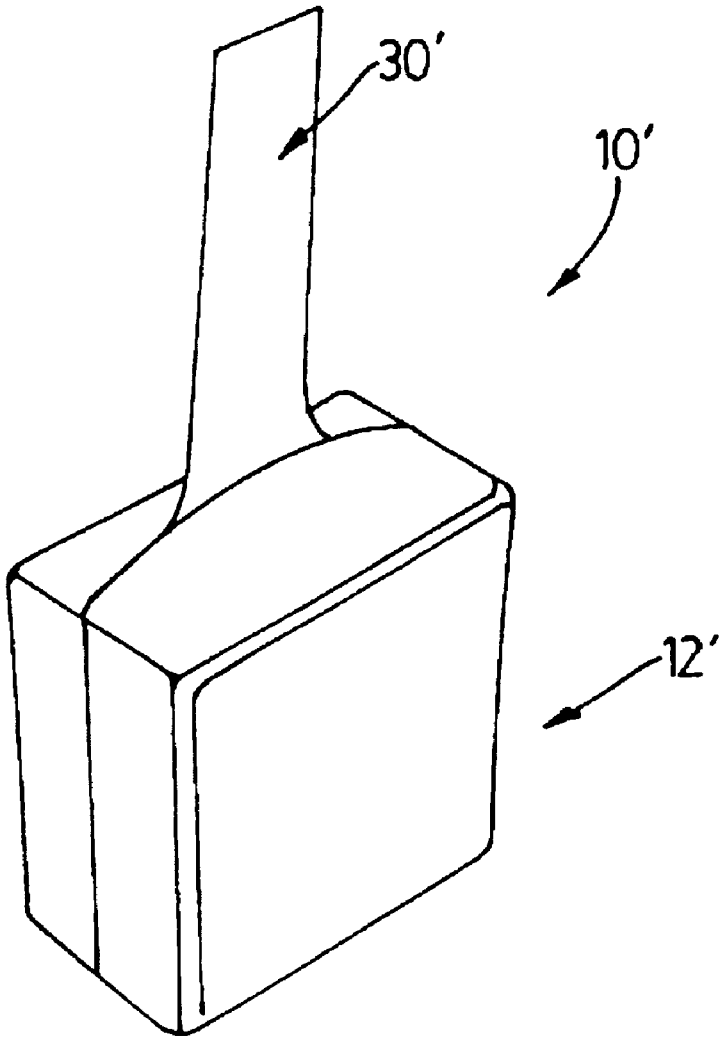
FIG. 5 is a perspective view of an alternative embodiment of a self-supporting container for fluids in accordance with the present invention.
Figure 6:
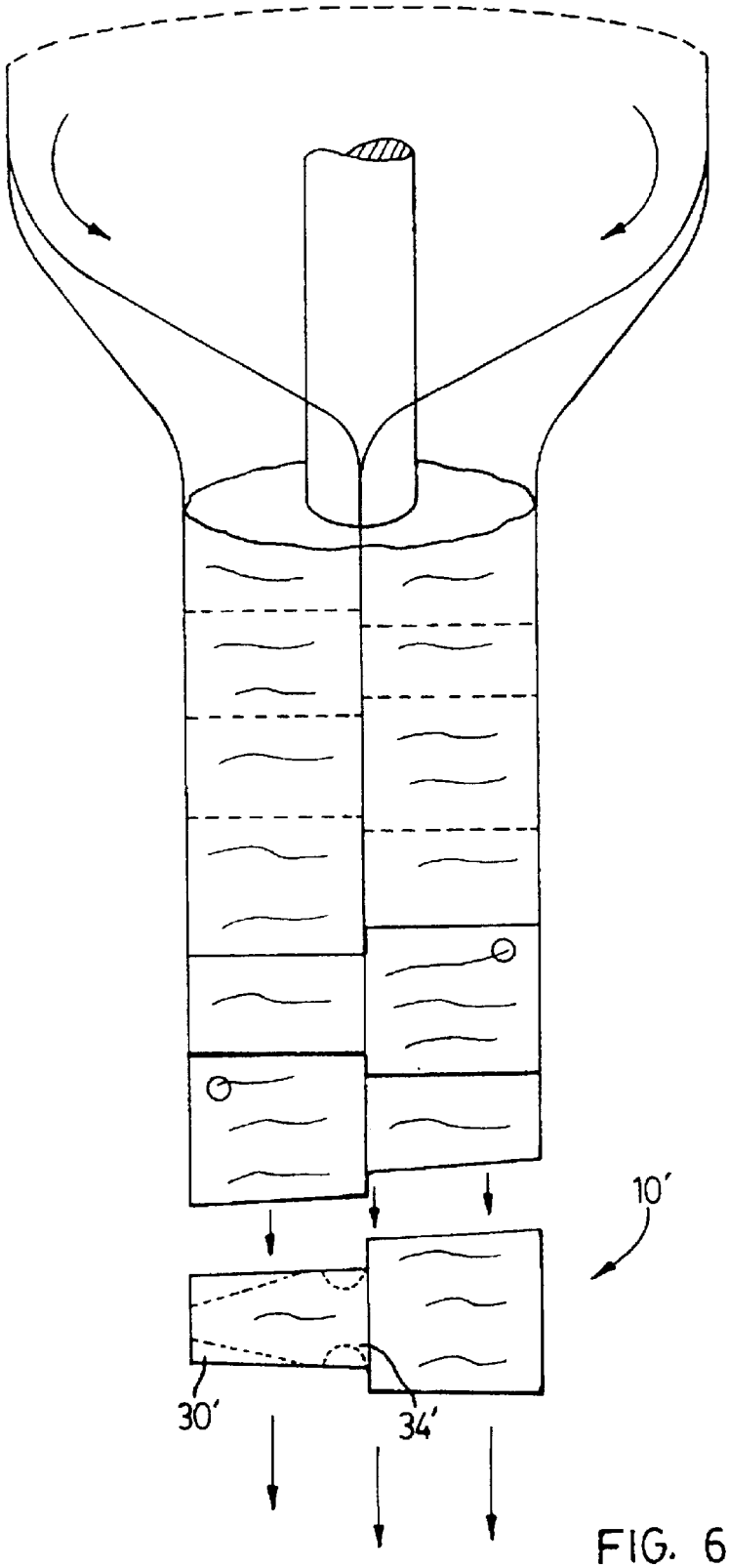
FIG. 6 is a side elevational view of yet another embodiment of an apparatus for forming and filling a tube with fluid and then partitioning the tube to form fluid-filled containers which when made self-supporting will be of the type illustrated in FIG. 5.

Referring now to FIGS. 5 and 6, another embodiment of a self-supporting container 10' and method of making the same is shown. In this embodiment, the body 12' of the container more closely resembles a rectangular parallelpiped than that of the previous embodiment. This of course, allows the containers to be more closely packed and therefore requires less packaging and shelf space.

To achieve this body design, during formation of the heat seals, the taper along the length of the spout 30' and the body 12' is removed. The taper within the spout 30' and the projections 34' at the junction between the body and spout are formed in a secondary heat sealing operation as illustrated by the dotted lines in FIG. 6. To make the container 10' self-supporting and to avoid inwardly tapering sidewalls, opposed sides of the body at their tops and bottoms are pushed inwardly and the corners of the sidewalls at the tops and bottoms are flattened and pinched to form triangular portion. Heat seals are then formed along the pinch lines and the triangular portions are either removed from the body or folded over and adhered to the sidewalls and/or base of the body. In this case the fluid displacement mechanisms displace sufficient fluid to provide room in the body 12' to accommodate these steps.

Figure 7:
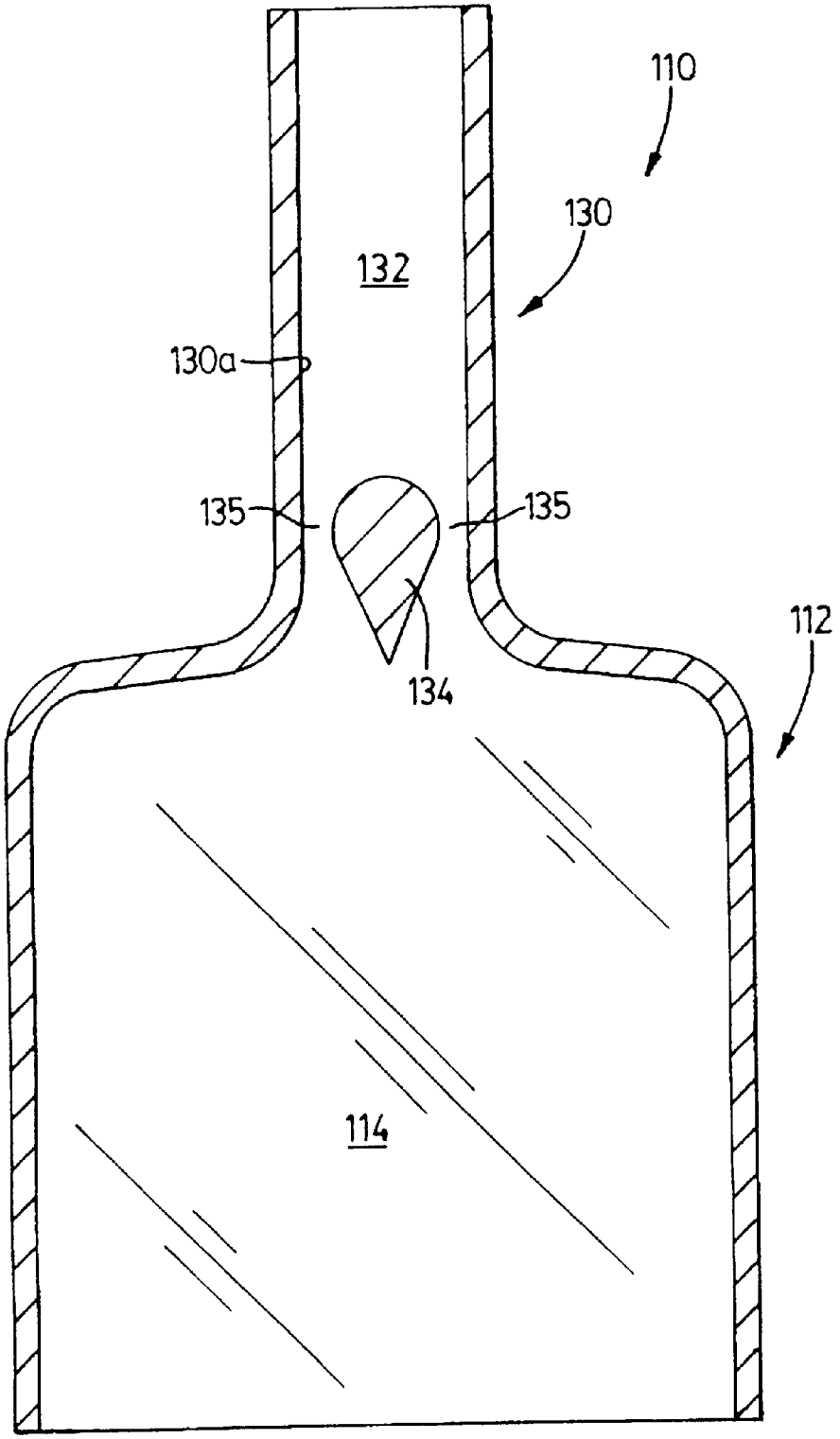
FIG. 7 is a cross-sectional view in side elevation of yet another embodiment of a container for liquids in accordance with the present invention.

Referring now to FIG. 7, yet another embodiment of a container for fluids is shown and is generally indicated by reference numeral 110. In this embodiment, like reference numerals will be used to indicate like components with a "100" added for clarity. In this embodiment, the restricted area in the passage 132 of the spout 130 is defined by an obstruction 134. The obstruction defines a pair of fluid flow paths 135 on opposite sides of the obstruction. The obstruction 134 resembles an inverted wing when viewed in bottom plan. Unlike the previous embodiment, the passage 132 has a generally constant diameter downstream of the obstruction 134.

Similar to the previous embodiment, when it is desired to dispense fluid from the reservoir 114 after the distal end of the spout 130 has been torn opened, pressure is applied to the body 112 causing fluid to flow from the reservoir into the spout 130. As fluid exits the reservoir 114, the fluid enters an increased pressure zone as it travels along flow paths 135. As the fluid passes by the obstruction, it immediately enters a low pressure zone to provide out-flowing fluid velocity control. The configuration of the obstruction 134 is such that drag is created immediately downstream of the obstruction. As a result, the drag helps to inflate the spout 130 obviating the need for the spout to be inwardly tapered.

Figure 8:
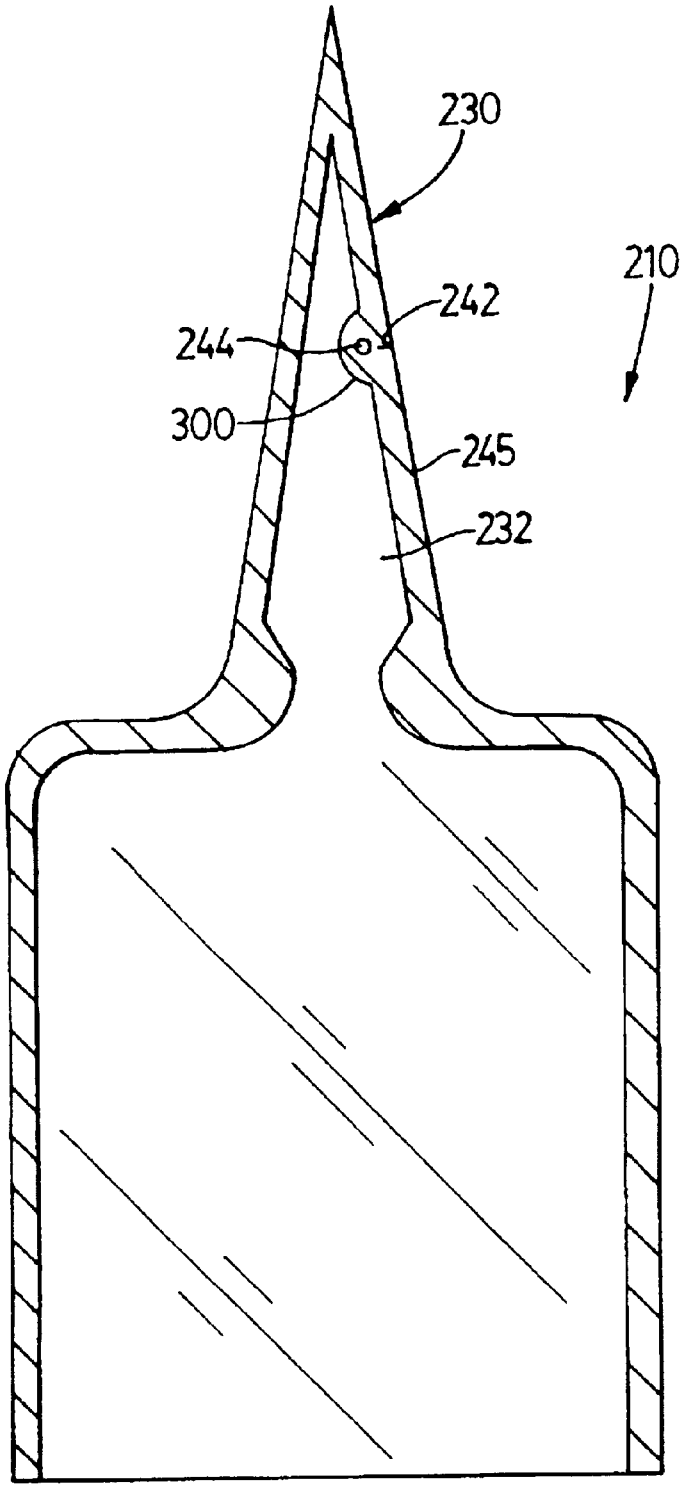
FIG. 8 is a cross-sectional view in side elevation of another embodiment of a liquid-filled container in accordance with the present invention.

Referring now to FIG. 8 still yet another embodiment of a fluid-filled container is shown and is generally indicated to be reference numeral 210. In this embodiment like reference numerals will be used to indicate like components with a "200" added for clarity. Container 210 is very similar to that of FIG. 1*a* except that during formation of the container, the spout 230 is generally triangular and comes to a point at its distal end. Near the distal end of the spout, a heat seal 300 is formed in the spout and projects partially into the internal passage 232. The heat seal 300 and seam 245 accommodate a slit 242 and a pin-hole 244 to facilitate tearing of the spout 230 along tear line 250.

As one of skill in the art will appreciate, the present invention provides advantages in that by reducing the pressure of fluid in the spout after it exits the reservoir, better out-flowing fluid velocity control is achieved while ensuring that the spout substantially fully inflates. It has been found that in the container disclosed in Applicant's U.S. Pat. No. 5,378,065, the contents of which are incorporated herein by reference, in some instances, the spout does not inflate when fluid passes through the restricted area into the spout. In this case, fluid entering the spout from the reservoir follows a path having a diameter basically the same as that of the restricted area. When this occurs, the desired pressure drop at the downstream side of the restriction does not occur.

The present invention also provides advantages in that by forming alternatively oriented, interlocked containers in a tube, fluid-filled containers can be formed with virtually no wasted material.

Although the container 10 has been described as being self-supporting, it should be appreciated that the containers need not be made self-supporting. In this instance, the sides of the container need not be tapered. Also, although the heat sealing bars have been described as being configured to define the projections 34, it should be apparent that these projections 34 can be formed in a secondary heat sealing operation. Furthermore, those of skill in the art will appreciate that other suitable processes to form the seals across the tube can be used and are well within the scope of the present invention. It should also be realized that variations and modifications may be made to the present invention without departing from the scope thereof was defined by the appended claims.

What is claimed is:

1. A method for forming fluid-filled containers from an upright tube formed of flexible material, said method comprising the steps of:

delivering fluid to said tube to fill at least a portion of said tube; and forming lower and then upper curved seals across said tube at vertically spaced locations below the fluid level in said tube, said curved seals being mirror images of one another and including upper and lower arm positions joined by bridges to define interlocking, alternately oriented fluid-filled containers having generally centrally disposed narrow spouts extending from wider main bodies.

2. The method of claim 1 further comprising the step of displacing fluid in said tube in an upstream direction prior to forming each curved seal.

3. The method of claim 2 wherein the multiple pairs of curved seals are formed across said tube in succession at a sealing station to form a string of interlocked containers, said tube being indexed thereafter to advance said tube to said sealing station.

4. The method of claim 2 wherein said upper and lower arm portions are configured to define tapered containers, the taper of the wider main bodies of said containers being the same as the taper of the spouts of said containers.

5. The method of claim 4 further comprising the steps of:

cutting said seals to separate individual containers from said tube;

pinching opposed bottom corners of said wider main body to form generally flattened portions extending outwardly therefrom; and forming seals along the pinch lines to provide a generally planar base for each separated container.

6. The method of claim 2 further comprising the step of perforating each of said seals.

7. The method of claim 2 further comprising the step of cutting said seals to separate individual containers from said tube.

8. The method of claim 7 wherein: said step of cutting is performed via die-cutting.

9. The method of claim 5 wherein said seals are formed by heat sealing along the pinch lines.

10. The method of claim 7 wherein a constant heat sealing bar is used to form said seals.

11. The method of claim 10 wherein said steps of forming said seals and separating said container are performed simultaneously via said heat sealing bar.

12. The method of claim 9 further comprising the step of removing said flattened portions from said body.

13. The method of claim 9 further comprising the step of folding said flattened portions about the seals formed along the pinch lines to overlie said base or sidewalls of said body and adhering said flattened portions.

* * * * *